US008201508B2

(12) United States Patent
Asai et al.

(10) Patent No.: US 8,201,508 B2
(45) Date of Patent: Jun. 19, 2012

(54) NEEDLE THREAD FEEDING DEVICE FOR MULTI-NEEDLE EMBROIDERY SEWING MACHINE

(75) Inventors: Masashi Asai, Ichinomiya (JP); Eikichi Yanagiya, Kasugai (JP); Shinichi Mizuno, Nagoya (JP)

(73) Assignee: Kabushikikaisha Barudan, Ichinomiya-shi, Aichi-ken (JP)

( * ) Notice: Subject to any disclaimer, the term of this patent is extended or adjusted under 35 U.S.C. 154(b) by 428 days.

(21) Appl. No.: 12/385,535

(22) Filed: Apr. 10, 2009

(65) Prior Publication Data

US 2009/0301368 A1 Dec. 10, 2009

(30) Foreign Application Priority Data

Jun. 5, 2008 (JP) ..... 2008-147909
Nov. 26, 2008 (JP) ..... 2008-301771

(51) Int. Cl.
*D05B 87/00* (2006.01)

(52) U.S. Cl. ..... 112/225

(58) Field of Classification Search ..... 112/225, 112/227, 233, 222, 245, 475.18, 220, 100, 112/80.08

See application file for complete search history.

(56) References Cited

U.S. PATENT DOCUMENTS

| | | | | |
|---|---|---|---|---|
| 4,006,697 | A * | 2/1977 | Robertson | 112/118 |
| 5,738,030 | A * | 4/1998 | Ok | 112/475.23 |
| 6,019,053 | A * | 2/2000 | Kawaguchi | 112/103 |
| 6,101,961 | A * | 8/2000 | Sakuma | 112/255 |
| 7,073,453 | B2 * | 7/2006 | Frazer et al. | 112/117 |
| 7,735,439 | B1 * | 6/2010 | Price et al. | 112/117 |

FOREIGN PATENT DOCUMENTS

| | | |
|---|---|---|
| JP | 59-59961 | 4/1984 |

* cited by examiner

*Primary Examiner* — Tejash Patel

(74) *Attorney, Agent, or Firm* — McGinn IP Law Group PLLC

(57) ABSTRACT

The present invention provides a needle thread feeding device for a multi-needle embroidery sewing machine which includes a drive roller having a length that extends across the plurality of needle threads, a needle thread guide mechanism that arranges the needle threads side by side in an axial direction of the drive roller and guides the needle threads, a pressure roller that presses the selected needle thread onto the drive roller, and a thread distributing mechanism that relatively moves the needle thread guide mechanism and the pressure roller in the axial direction of the drive roller in synchronization with movement of the sewing machine head. The thread distributing mechanism interposes the selected needle thread between the drive roller and the pressure roller.

20 Claims, 14 Drawing Sheets

NEEDLE THREAD FEEDING DEVICE FOR MULTI-NEEDLE EMBROIDERY SEWING MACHINE

TECHNICAL FIELD

The present invention relates to a needle thread feeding device for a multi-needle embroidery sewing machine that feeds out, out of a plurality of needle threads, a selected needle thread passing through a needle in a sewing position from a needle thread supply source to the needle.

BACKGROUND ART

Generally, in a multi-needle embroidery sewing machine, needle threads of different colors are passed through a plurality of corresponding needles provided on a sewing machine head. In such multi-needle embroidery sewing machine, a color change mechanism moves the sewing machine head to locate one of the needles in a sewing position, and a multi-color embroidery pattern is formed on a work cloth held on an embroidery frame with the selected needle thread passing through the needle in the sewing position. In such kind of embroidery sewing machine, there has conventionally been known a needle thread feeding device in which the quantity of use of the selected needle thread is predetermined by considering the quantity of movement of the embroidery frame as well as the materials of the needle thread and the cloth, and the predetermined quantity of the selected needle thread is fed out from a needle thread supply source to the needle in the sewing position.

For example, the needle thread feeding device described in Patent Literature 1 (Japanese Patent Application Publication No. JP-A-59-59961) is equipped with the same number of feed rollers as the number of needles on the sewing machine head. Each of the feed rollers is connected to a motor through a switching mechanism, and rotational speed of the motor is controlled based on a predetermined quantity of use of a thread. The needle thread feeding device is then structured so as to wind a plurality of needle threads on the respectively different feed rollers, to selectively transmit power of the motor to each of the feed rollers through gears of the switching mechanism, and to feed out the predetermined quantity of the selected needle thread to the needle in a sewing position.

SUMMARY OF INVENTION

Technical Problem

However, because the conventional needle thread feeding device requires the same number of the feed rollers as the number of the needles, there has been a problem that not only the number of rollers but also the number of gears of the switching mechanism increases, thereby making the structure of the sewing machine head complicated. In addition, because the needle threads are respectively wound on the corresponding feed rollers, there have been problems in that threading of the needles is complicated and remaining curls generated damage the texture of the embroidery pattern when needle threads with weak stiffness such as loosely twisted threads are used.

It is an object of the present invention to provide a needle thread feeding device for a multi-needle embroidery sewing machine that solves the problems described above, and that is capable of holding one of a plurality of needle threads with two rollers and feeding out the selected needle thread in a stretched state to a needle in a sewing position.

Solution to Problem

In order to solve the aforementioned problems, a needle thread feeding device for a multi-needle embroidery sewing machine that moves a sewing machine head to selectively locate one of a plurality of needles in a sewing position, and feeds out, out of a plurality of needle threads, a selected needle thread (embroidery thread) passing through the needle in the sewing position from a needle thread supply source to the needle, according to the present invention, includes: a drive roller having a length that extends across the plurality of needle threads; a needle thread guide mechanism that arranges the needle threads side by side in an axial direction of the drive roller and guides the needle threads; a pressure roller that presses the selected needle thread onto the drive roller; and a thread distributing mechanism that relatively moves the needle thread guide mechanism and the pressure roller in the axial direction of the drive roller in synchronization with movement of the sewing machine head, wherein the thread distributing mechanism interposes the selected needle thread between the drive roller and the pressure roller.

In addition, the present invention provides a device in which the thread distributing mechanism utilizes movement of the sewing machine head and a device in which the thread distributing mechanism is provided with a drive unit exclusive thereto. In the former needle thread feeding device, the drive roller and the pressure roller are installed on a sewing machine frame; the needle thread guide mechanism is provided so as to be movable as a unit with the sewing machine head; and the thread distributing mechanism moves the needle thread guide mechanism relative to the pressure roller in the axial direction of the drive roller. A color change mechanism already existing on the multi-needle embroidery sewing machine can be used as a device for moving the sewing machine head.

In the latter needle thread feeding device, the drive roller and the needle thread guide mechanism are installed on the sewing machine frame; the pressure roller is provided so as to be movable relative to the sewing machine frame; and the thread distributing mechanism moves the pressure roller relative to the needle thread guide mechanism in the axial direction of the drive roller.

As the needle thread guide mechanism, the mechanism described below can be preferably employed from a viewpoint that it can stabilize feeding of the selected needle thread.

(a) The needle thread guide mechanism provided with a flexible member that applies a tension to the needle threads on the upstream side from the drive roller (the thread supply source side) in the needle thread feeding direction.

(b) The needle thread guide mechanism provided with a scraper that scrapes the needle thread off a surface of the drive roller.

(c) The needle thread guide mechanism provided with a pair of thread guides that oppose each other at a distance substantially equal to a diameter of the drive roller.

(d) The needle thread guide mechanism wherein the thread guide is provided with a threading hole that guides the needle threads while spacing apart the needle threads from the drive roller.

Furthermore, it is desirable for the needle thread feeding device to include a switching mechanism that switches between a pressing state in which the pressure roller presses the selected needle thread onto the drive roller and a non-pressing state in which the pressure roller does not press the selected needle thread;

a holding unit that applies a tension to the selected needle thread by holding the selected needle thread on the upstream side (the thread supply source side) or the downstream side (the needle side) from the drive roller in the needle thread feeding direction; an open/close mechanism that switches between a holding state in which the holding unit holds the selected needle thread and a non-holding state in which the holding unit does not hold the selected needle thread; and a control unit that controls the switching mechanism and the open/close mechanism to switch between: a roller-in-use state in which the pressure roller is made to be in the pressing state while the holding unit is made to be in the non-holding state; and a holding-unit-in-use state in which the pressure roller is made to be in the non-pressing state while the holding unit is made to be in the holding state.

Thus, in the situation in which the quantity of use of the selected needle thread can be easily predicted, the roller-in-use state is employed, whereas in the situation in which the quantity of use of the selected needle thread can not be easily predicted, the holding-unit-in-use state is employed. Consequently, both of the situations can be appropriately dealt with.

Advantageous Effects of Invention

The needle thread feeding device according to the present invention uses the drive roller having a length that extends across the plurality of needle threads, moves the needle thread guide mechanism or the pressure roller relative to the drive roller, holds the selected needle thread between the drive roller and the pressure roller, and is thereby capable of feeding out the selected needle thread in a stretched state. Therefore, there are such effects that the number of rollers can be reduced, threading of the needles is easily performed, and the remaining curls of the selected needle thread can be eliminated, thereby improving the texture of the embroidery pattern.

DESCRIPTION OF EMBODIMENTS

Figure 1:
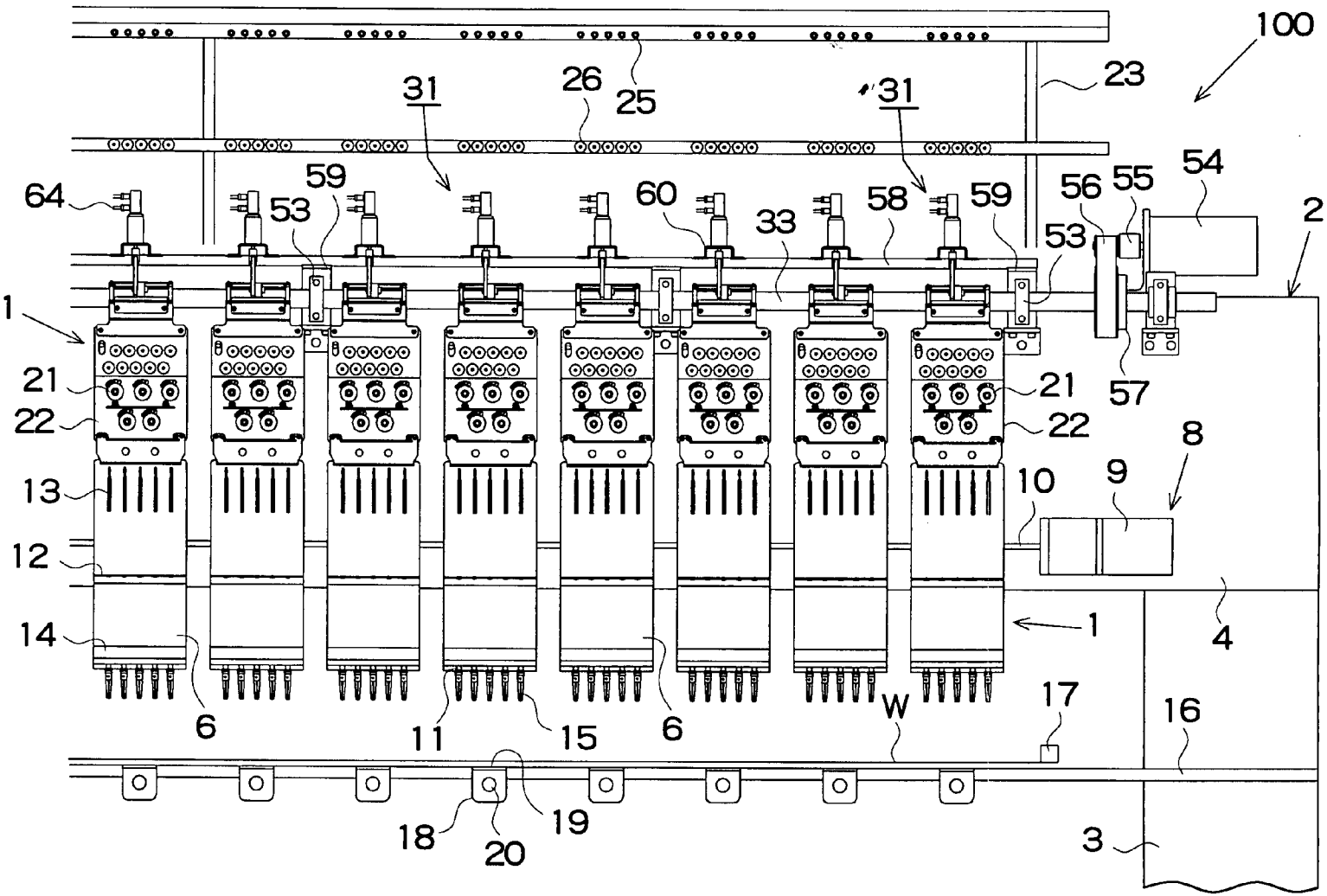
FIG. 1 is a front view of a multi-head embroidery sewing machine showing a first embodiment of the present invention.

In a multi-needle embroidery sewing machine (1) that moves a sewing machine head (6) to selectively locate one of a plurality of needles (15) in a sewing position, and feeds out, out of a plurality of needle threads (T), a selected needle thread (ET) passing through the needle (15) in the sewing position from a needle thread supply source (24) to the needle (15), this needle thread feeding device (31) is provided with a drive roller (33) having a length that extends across the needle threads (T), a needle thread guide mechanism (32) that arranges the needle threads (T) side by side in an axial direction of the drive roller (33) and guides the needle threads (T), a pressure roller (34) that presses the selected needle thread (ET) onto the drive roller (33), and a thread distributing mechanism (36) that interposes the selected needle thread (ET) between the drive roller (33) and the pressure roller (34) insynchronization with movement of the sewing machine head (6) The drive roller (33) and the pressure roller (34) are installed on a sewing machine frame (2), the needle thread guide mechanism (32) is provided so as to be movable as a unit with the sewing machine head (6), and the thread distributing mechanism (36) moves the needle thread guide mechanism (32) relative to the pressure roller (34) in the axial direction of the drive roller (33).

First Embodiment

Figure 2:
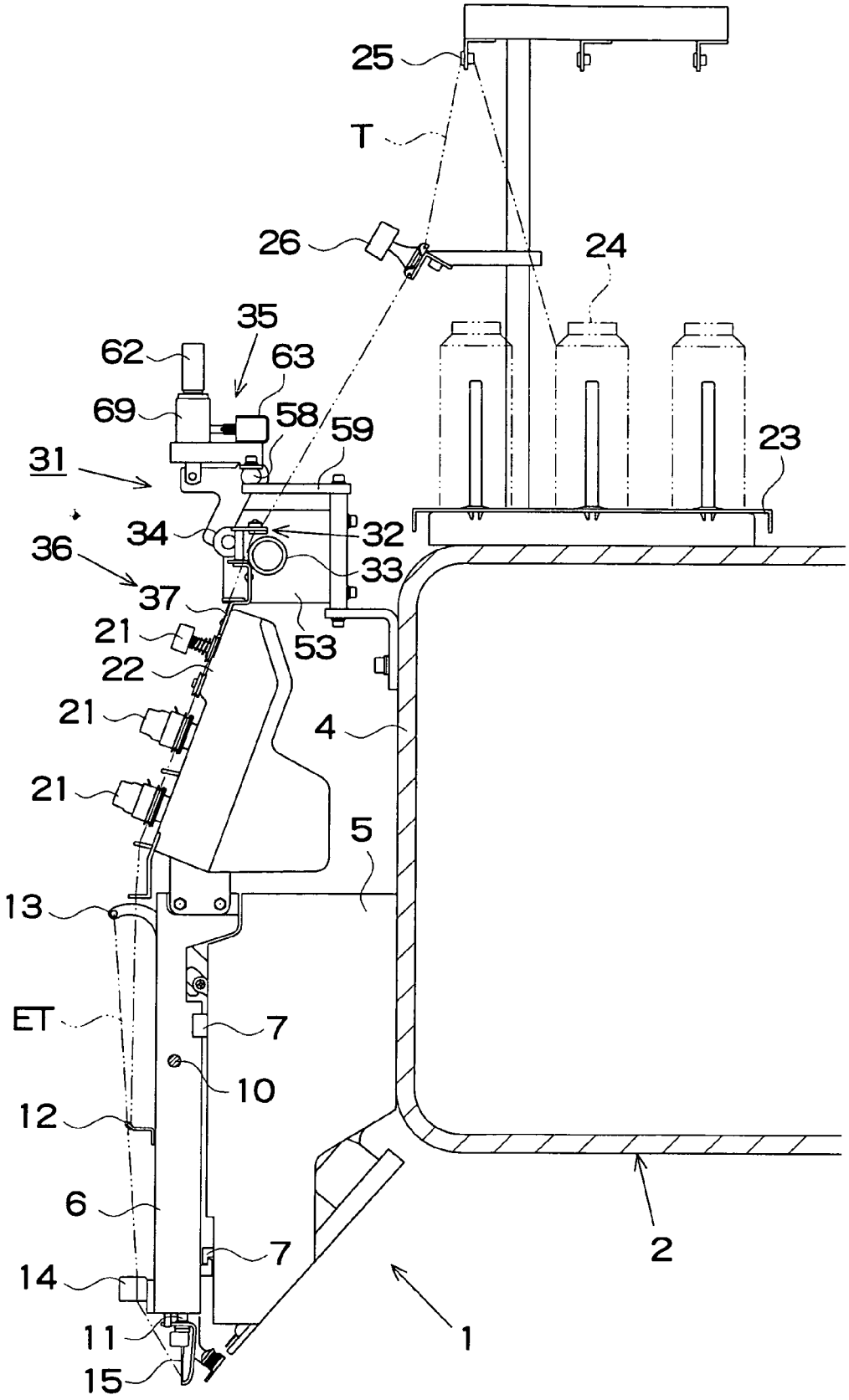
FIG. 2 is a side view showing a single unit of multi-needle embroidery sewing machine.

A first embodiment of the present invention will be described below based on FIGS. 1 to 8. As shown in FIGS. 1 and 2, a multi-head embroidery sewing machine 100 of the present embodiment is structured such that a plurality (for example, 56 units) of multi-needle embroidery sewing machines 1 are arranged side by side in the right-left direction of a sewing machine frame 2. The sewing machine frame 2 is equipped with a support column portion 3 and a beam portion 4, and an arm 5 of the multi-needle embroidery sewing machine 1 is provided so as to protrude on the front surface of the beam portion 4. A sewing machine head 6 is slidably supported by a rail 7 in the right-left direction on the front surface of the sewing machine arm 5, and the heads 6 of all the embroidery sewing machines 1 are concurrently driven by a motor 9 of a color change mechanism 8 through a connecting rod 10.

The sewing machine head 6 is provided with pluralities (for example, 5 pieces) of needle bars 11, thread guides 12, needle thread take-ups 13, and thread catchers 14, and a needle 15 is attached to the lower end of each of the needle bars 11. A table 16 is provided below the sewing machine head 6, and an embroidery frame 17 for holding a work cloth W is mounted on the table 16 in a movable manner in the X-Y direction. A sewing machine bed 18 located at the same height as the table 16 is provided with a needle plate 19 and a rotary hook 20, and by sliding of the sewing machine head 6, one of the plurality of needles 15 is selectively located in a sewing position coordinating with the rotary hook 20.

As shown in FIGS. 2 and 3, a tension base 22 is installed at the upper end of the sewing machine head 6, and a plurality of thread tension devices 21 and a switch 27 for individually halting the operation of the embroidery sewing machine 1 are arranged on the front surface of the tension base 22. The beam portion 4 on the upper side of the tension base 22 is provided with a thread stand 23 and a needle thread feeding device 31, and a multitude of bobbins 24 serving as a needle thread supply source are mounted on the thread stand 23. Moreover, a needle thread T unwound from the bobbin 24 is supplied through a thread hook 25 and a tensioner 26 to the needle thread feeding device 31, and the needle thread feeding device 31 feeds out one selected needle thread ET out of the same number of the needle threads T as the number of the needles 15, through the thread tension device 21, the needle thread take-up 13, and so forth, to the needle 15 located in the sewing position.

The needle thread feeding device 31 is provided with a needle thread guide mechanism 32, a drive roller 33, a pressure roller 34, and a switching mechanism 35 on a thread path between the thread stand 23 and the tension base 22. The needle thread guide mechanism 32 is mounted at the top of the tension base 22, and guides in the up-down direction the plurality of needle threads T arranged in the right-left direction. The drive roller 33 is located on the rear side of the needle thread guide mechanism 32, and extends long in the right-left direction so as to pass across the needle threads T. The pressure roller 34 opposes the drive roller 33 from the front, and presses the one selected needle thread ET to the drive roller 33.

The switching mechanism 35 is located above the pressure roller 34, and drives the pressure roller 34 to a position to engage with the drive roller 33 and to a position to disengage from the drive roller 33. The drive roller 33, the pressure roller 34, and the switching mechanism 35 are installed on the beam portion 4, and operate in fixed positions in the right-left direction of the sewing machine frame 2. The needle thread guide mechanism 32 is equipped with a base 37 mounted on the tension base 22, and the base 37 and the color change mechanism 8 compose a thread distributing mechanism 36. The thread distributing mechanism 36 moves as a unit with the sewing machine head 6, slides the needle thread guide mechanism 32 to the right and left relative to the pressure roller 34, and interposes the selected needle thread ET between the drive roller 33 and the pressure roller 34.

Figure 4:
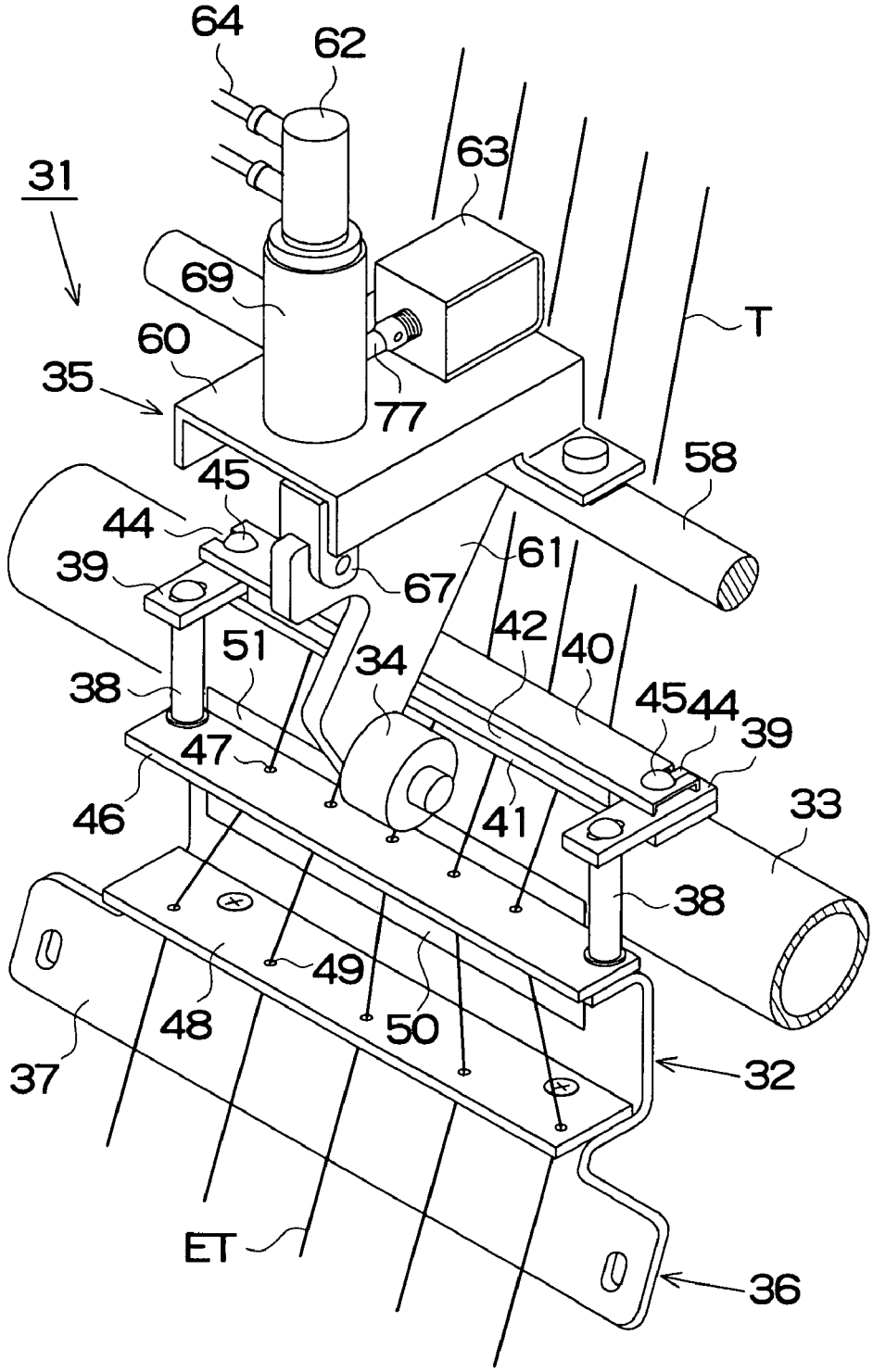
FIG. 4 is a perspective view showing a drive roller and a pressure roller of the needle thread feeding device.
Figure 5:
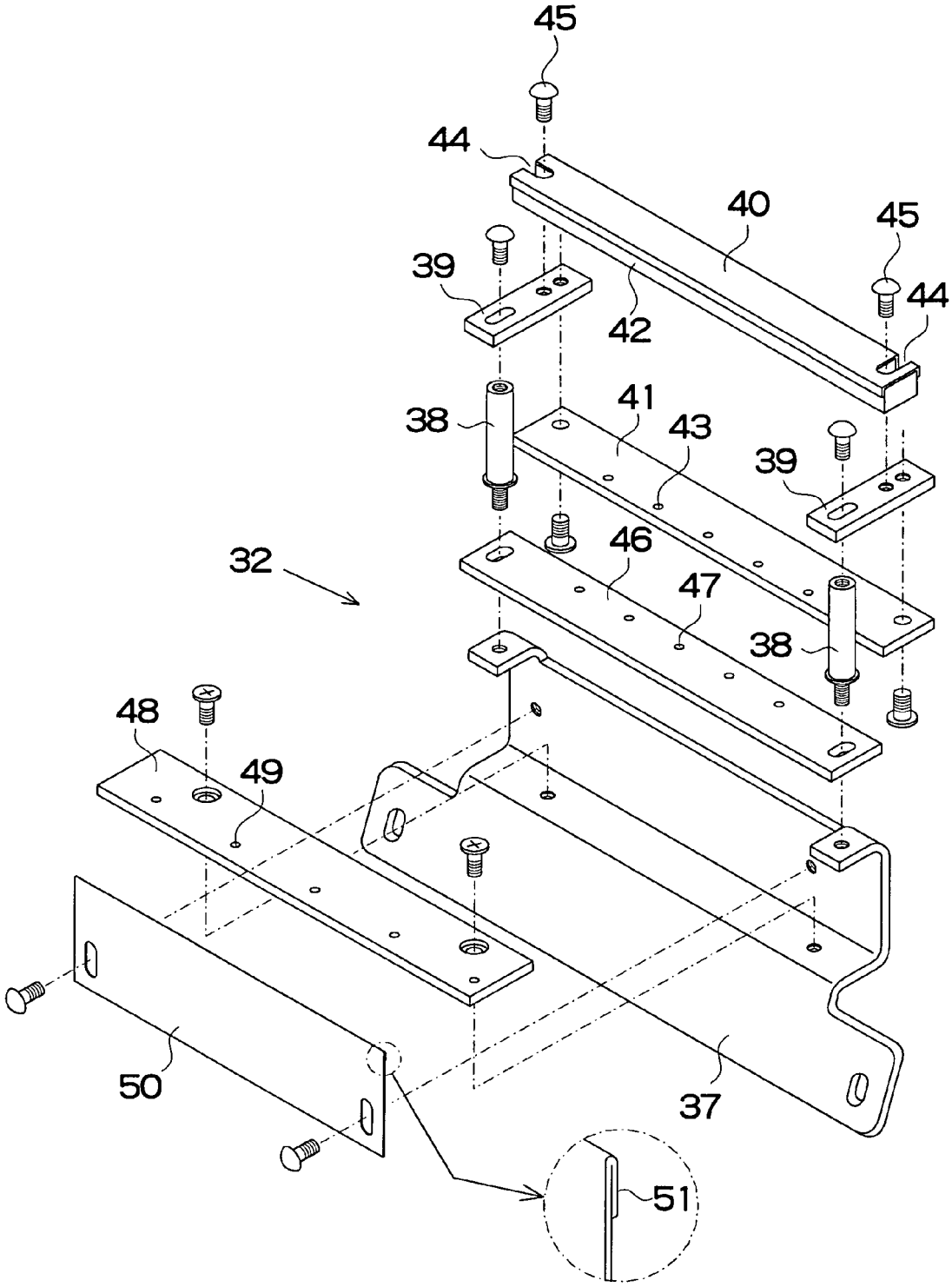
FIG. 5 is an exploded perspective view showing a needle thread guide mechanism of the needle thread feeding device.
Figure 6:
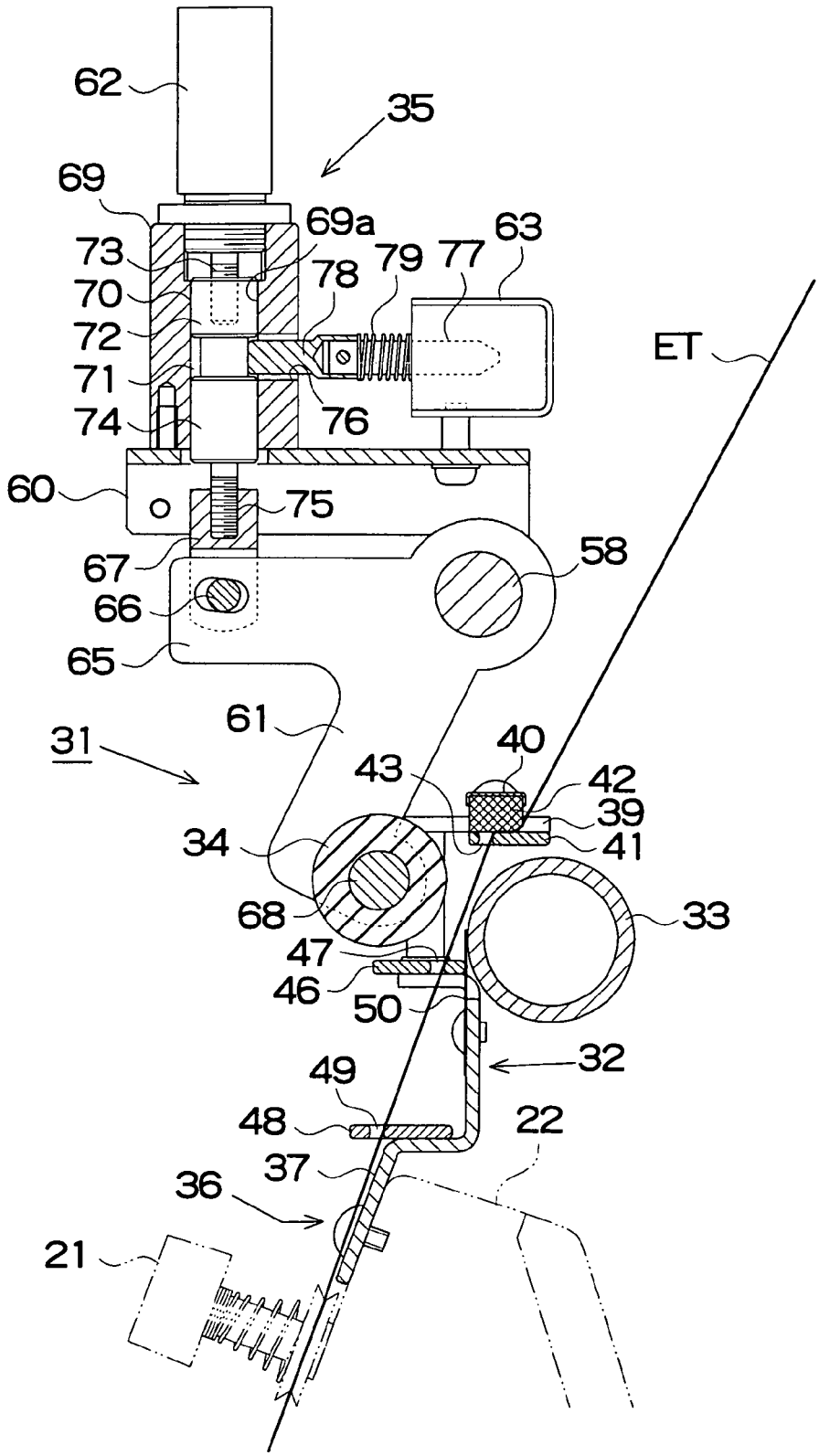
FIG. 6 is a cross-sectional view showing a switching mechanism of the needle thread feeding device.

As shown in FIGS. 4, 5, and 6, a pair of right and left support bars 38 are arranged upright on the upper surface of the base 37, and an arm 39 is attached to the upper end of each of the support bars 38. The arms 39 overhang above the drive roller 33, and the upper and the lower sides of the overhanging portion are mounted with a needle thread introducing plate 40 and a first thread guide 41, respectively. The lower surface of the needle thread introducing plate 40 is bonded with a flexible member 42 such as a felt, and the first thread guide 41 is provided with the same number of threading holes 43 as the number of the needle threads T. Note that the needle thread introducing plate 40 is attached, at both ends thereof, to the arms 39 by using notches 44 and screws 45 in a rotatable and detachable manner.

The flexible member 42 is bonded to the upper surface of the first thread guide 41 on the upstream side from the drive roller 33 in the needle thread feeding direction, and applies a tension to the needle threads T passing through the threading holes 43. Consequently, the needle threads T can be stretched into straight lines on the lower side of the threading holes 43, and the one selected needle thread ET can be precisely held by using the pressure roller 34. On the lower side of the first thread guide 41, a second thread guide 46 is mounted at the upper end of the base 37. The first thread guide 41 and the second thread guide 46 vertically oppose each other at a distance equal to or smaller than the diameter of the drive roller 33, and suppress thread vibration associated with movement of the base 37, thereby stabilizing the arrangement of the needle threads T.

Threading holes 47 of the second thread guide 46 are provided on the front side of the threading holes 43 of the first thread guide 41, and the upper and the lower threading holes 43 and 47 guide the needle threads T while spacing apart the needle threads T from the drive roller 33. As a result, the rotational force of the drive roller 33 is not transmitted to the needle threads T other than the selected needle thread ET so that the needle threads T can be held in a stationary state and an electrostatic charge due to friction can be prevented. On the lower side of the second thread guide 46, a third thread guide 48 is mounted at an intermediate height of the base 37, and from threading holes 49 of this thread guide 48, the needle threads T are distributed to the tension base 22.

On the rear side of the second thread guide 46 and the third thread guide 48, a scraper 50 is mounted on the front surface of the base 37. The scraper 50 is formed of a sheet material, and a folded portion 51 at the upper end thereof is lightly in contact with the surface of the drive roller 33 on the lower side of the engaging portion between the drive roller 33 and the pressure roller 34 (refer to FIG. 7). Moreover, the scraper 50 scrapes the selected needle thread ET off the surface of the drive roller 33 with the folded portion 51, thereby preventing the selected needle thread ET from being caught by the drive roller 33 and enabling to smoothly guide the selected needle thread ET into the threading hole 47 of the second thread guide 46.

As shown in FIGS. 1 and 2, the drive roller 33 is composed of a long-sized metal pipe, extends across several or all of the multi-needle embroidery sewing machines 1, and is supported to the beam portion 4 by a plurality of bearings 53. One end of the beam portion 4 is mounted with a motor 54, and an output portion 55 thereof is coupled to an end of the drive roller 33 through a belt 56 and a variable speed pulley 57. The motor 54 is controlled by a controller (not shown) shared by all of the embroidery sewing machines 1, and the drive roller 33 is driven at a rotational speed based on the needle thread feed data in an embroidery program.

In the present embodiment, a metal pipe with a diameter of 25 mm is used for the drive roller 33, and the surface of the pipe is used as a needle thread holding surface without any processing. Consequently, by narrowing the distance between the first and the second thread guides 41 and 46 to approximately 20 mm, the needle threads T can be guided in a stable state. In addition, the necessity of providing another roller on the metal pipe is eliminated, thus enabling to share one piece of the drive roller 33 to selectively feed out the plurality of needle threads T. As a result, the number of parts of the needle thread feeding device 31 can be reduced. There is also an advantage that the static electricity generated on the needle threads T can be discharged to the metal pipe so as to prevent the selected needle thread ET from being stuck.

As shown in FIGS. 1 and 4, a long-sized mounting shaft 58 is installed above the drive roller 33, and assembled to the beam portion 4 with brackets 59. A base plate 60 and a lever 61 of the switching mechanism 35 are mounted on the mounting shaft 58 in a position corresponding to each of the multi-needle embroidery sewing machines 1, and on the base plate 60, an air cylinder 62 for performing operation/stop switching of the needle thread feeding device 31 and a solenoid 63 for locking the air cylinder in an urged state are installed. Each of the air cylinders 62 is connected to an air supply source (not shown) shared by all of the embroidery sewing machines 1 by using an air piping 64, and all of the air cylinders 62 are urged by pressurized air while the multi-head embroidery sewing machine 100 is in operation.

Figure 7:
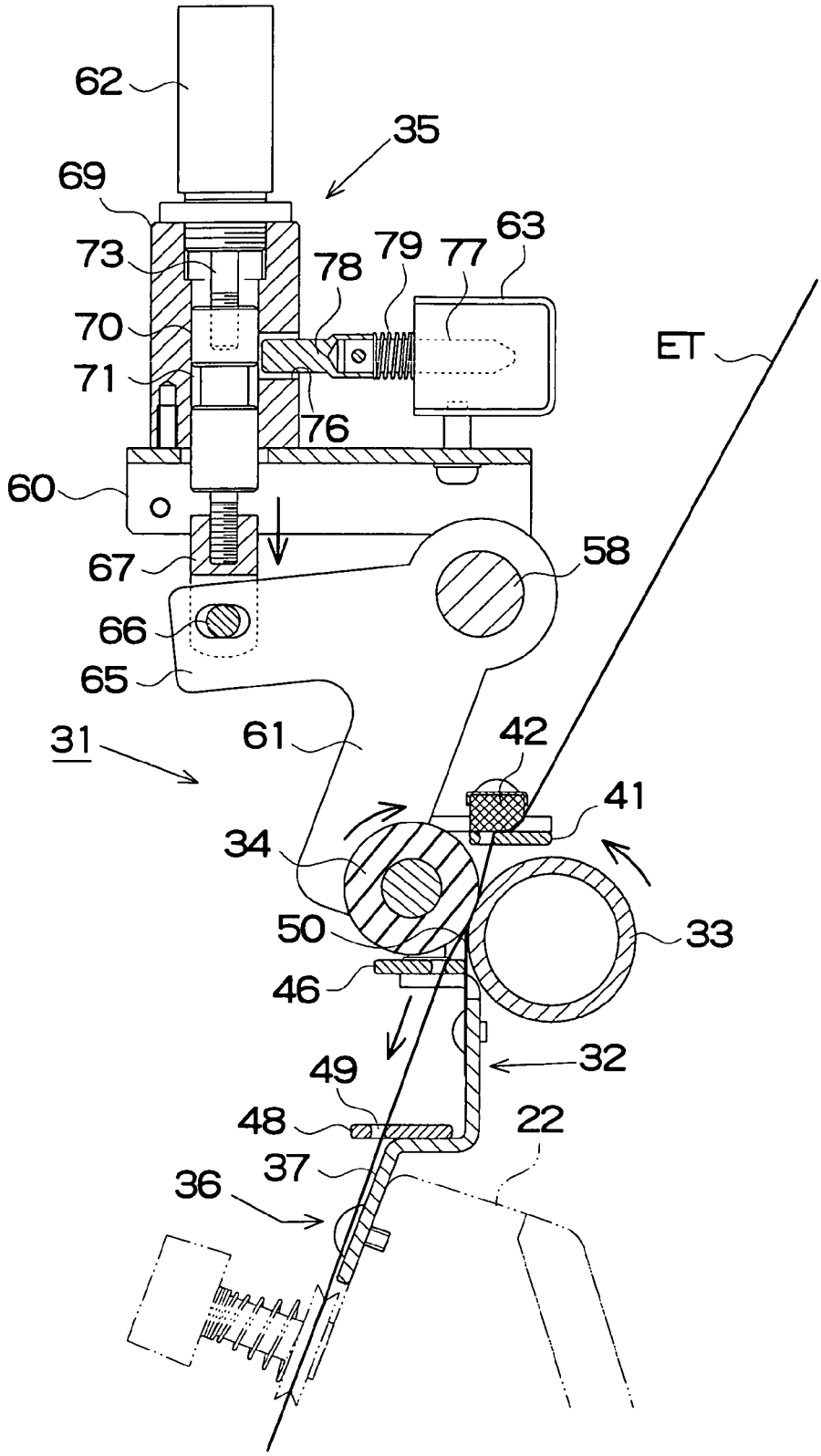
FIG. 7 is a cross-sectional view showing a needle thread holding operation by the pressure roller.

As shown in FIGS. 6 and 7, the lever 61 is formed in a forked shape, with an intermediate portion thereof rotatably supported on the mounting shaft 58. A front end input portion 65 of the lever 61 is linked by a pin 66 to an output block 67 of the air cylinder 62, and the pressure roller 34 is supported to the lower end of the lever 61 by a roller shaft 68. The pressure roller 34 is formed of a flexible material, such as rubber, into a size suitable to hold only one selected needle thread ET. The pressure roller 34 is pressed onto the drive roller 33 when the lever 61 has rotated downward, and separated from the drive roller 33 when the lever 61 has rotated upward.

The air cylinder 62 is mounted at the upper end of a guide member 69, and the guide member 69 is installed in a fixed manner to the base plate 60. The guide member 69 is formed into a cylindrical shape provided with a guide hole 69*a* that is coaxial with an output shaft 73 of the air cylinder 62, and a coupling 70 with a larger diameter than that of the output shaft 73 is slidably inserted in the guide hole 69*a*. The coupling 70 is provided with a locking groove 71 in an intermediate portion thereof, and the output shaft 73 is connected to a portion 72 on the upper side of the locking groove 71 whereas a screw 75 is provided in a protruding manner at a portion 74 on the lower side of the locking groove 71. Moreover, the screw 75 is connected to the input portion 65 of the lever 61 through the output block 67.

The solenoid 63 is installed on the base plate 60 in the vicinity of the guide member 69, and a plunger 77 of the solenoid 63 is provided perpendicularly to the output shaft 73. A stopper 78 of a pin shape is coaxially attached to the plunger 77, and a spring 79 for urging the stopper 78 toward the guide member 69 is interposed between a base end surface of the stopper 78 and the solenoid 63. An end of the stopper 78 is locked to the locking groove 71 of the coupling 70 through a horizontal hole 76 of the guide member 69 when the solenoid 63 is in a demagnetized state, and unlocked from the locking groove 71 when the solenoid 63 is in a magnetized state.

Figure 3A:
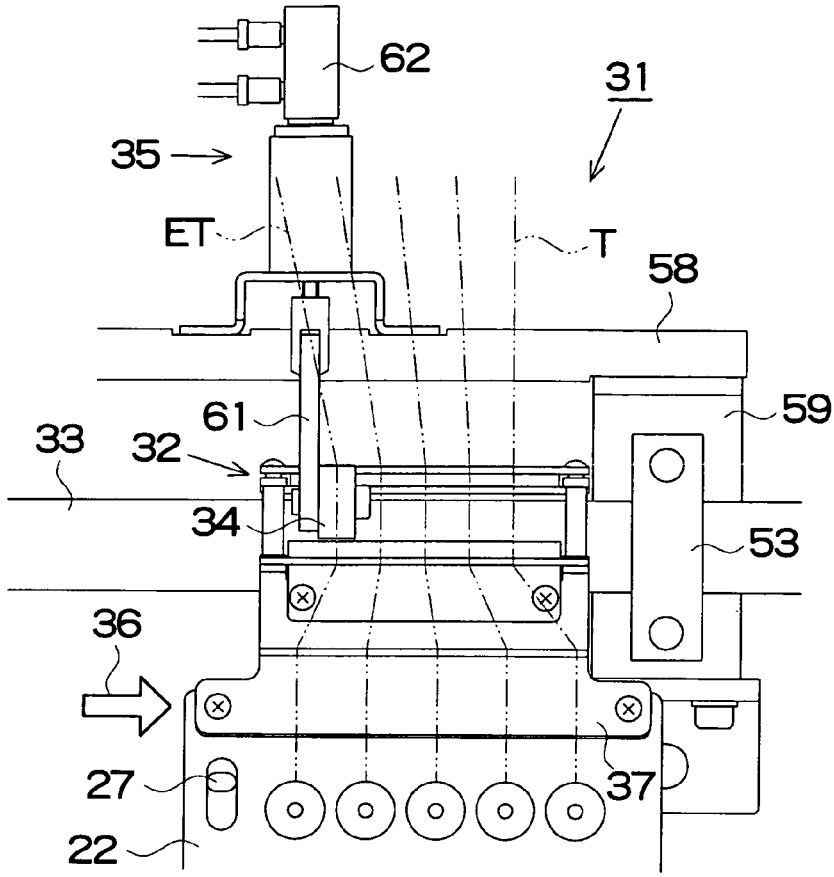
FIGS. 3A and 3B are front views showing a needle thread feeding device for the multi-needle embroidery sewing machine.
Figure 3B:
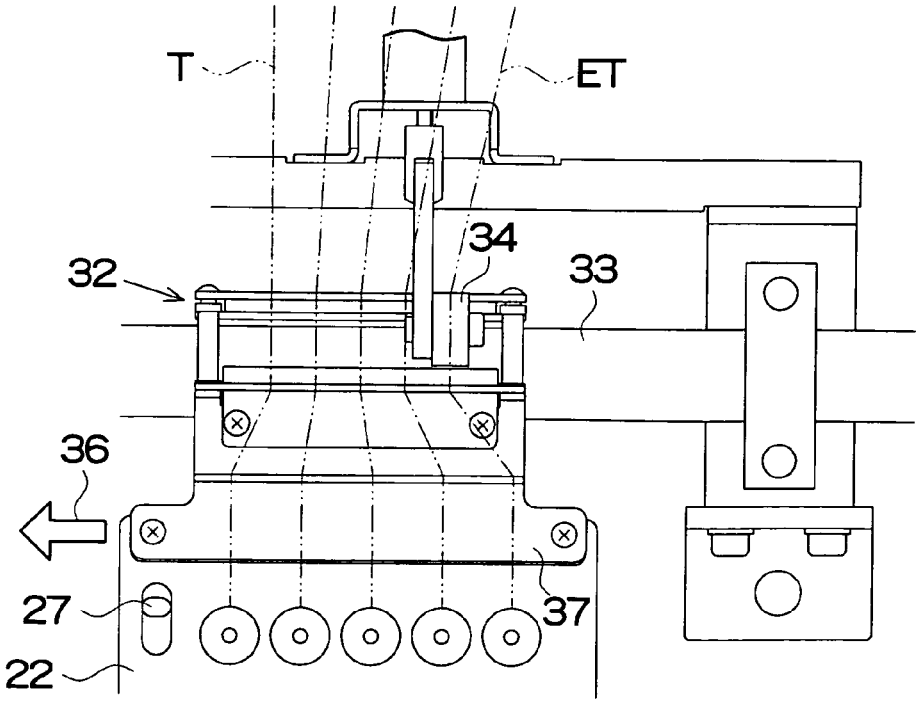

The multi-needle embroidery sewing machine 1 structured as described above changes color of the needle thread T in a state in which the pressure roller 34 is separated from the drive roller 33, as shown in FIG. 6. At this time, in the needle thread feeding device 31, the output shaft 73 of the air cylinder 62 is stopped in the upper limit position; the solenoid 63 is demagnetized; and the stopper 78 is locking the coupling 70. In this state, the color change mechanism 8 slides the sewing machine head 6 to locate one of the needles 15 in the sewing position. Then, as shown in FIGS. 3A and 3B, the thread distributing mechanism 36 slides in the right-left direction as a unit with the tension base 22, moves the needle thread guide mechanism 32 relative to the pressure roller 34, and interposes the one selected needle thread ET between the drive roller 33 and the pressure roller 34.

After the color change has been finished, the solenoid 63 is magnetized to draw the plunger 77, and the stopper 78 separates from the coupling 70 to release the output shaft 73 of the air cylinder 62, as shown in FIG. 7. As a result, the output shaft 73 protrudes from the upper limit position to the lower limit position, then the lever 61 rotates downward, and then the pressure roller 34 presses the selected needle thread ET onto the drive roller 33. Then, the needle 15 moves up and down in each of the embroidery sewing machines 1; the drive roller 33 rotates at a preprogrammed speed; and a predetermined quantity of the selected needle thread ET is drawn out of the bobbin 24 and fed out through the flexible member 42 and the thread guides 41, 46, and 48 of the needle thread guide mechanism 32, to the needle 15 in the sewing position.

According to the needle thread feeding device 31 of the present embodiment, because the drive roller 33 shared by the plurality of multi-needle embroidery sewing machines 1 is used, the selected needle thread ET can be held between the drive roller 33 and the pressure roller 34 that is provided one for each of the embroidery sewing machines 1, and fed out in a stretched state. Consequently, the number of parts of the needle thread feeding device 31 can be reduced, and the operation of winding the needle threads T can be saved. Moreover, the remaining curls of the selected needle thread ET can also be eliminated. Particularly, because the power of the color change mechanism 8 is utilized to move the needle thread guide mechanism 32, the thread distributing mechanism 36 can be driven without a drive unit exclusive thereto, thereby enabling to distribute the selected needle thread ET with a low cost structure.

Figure 8:
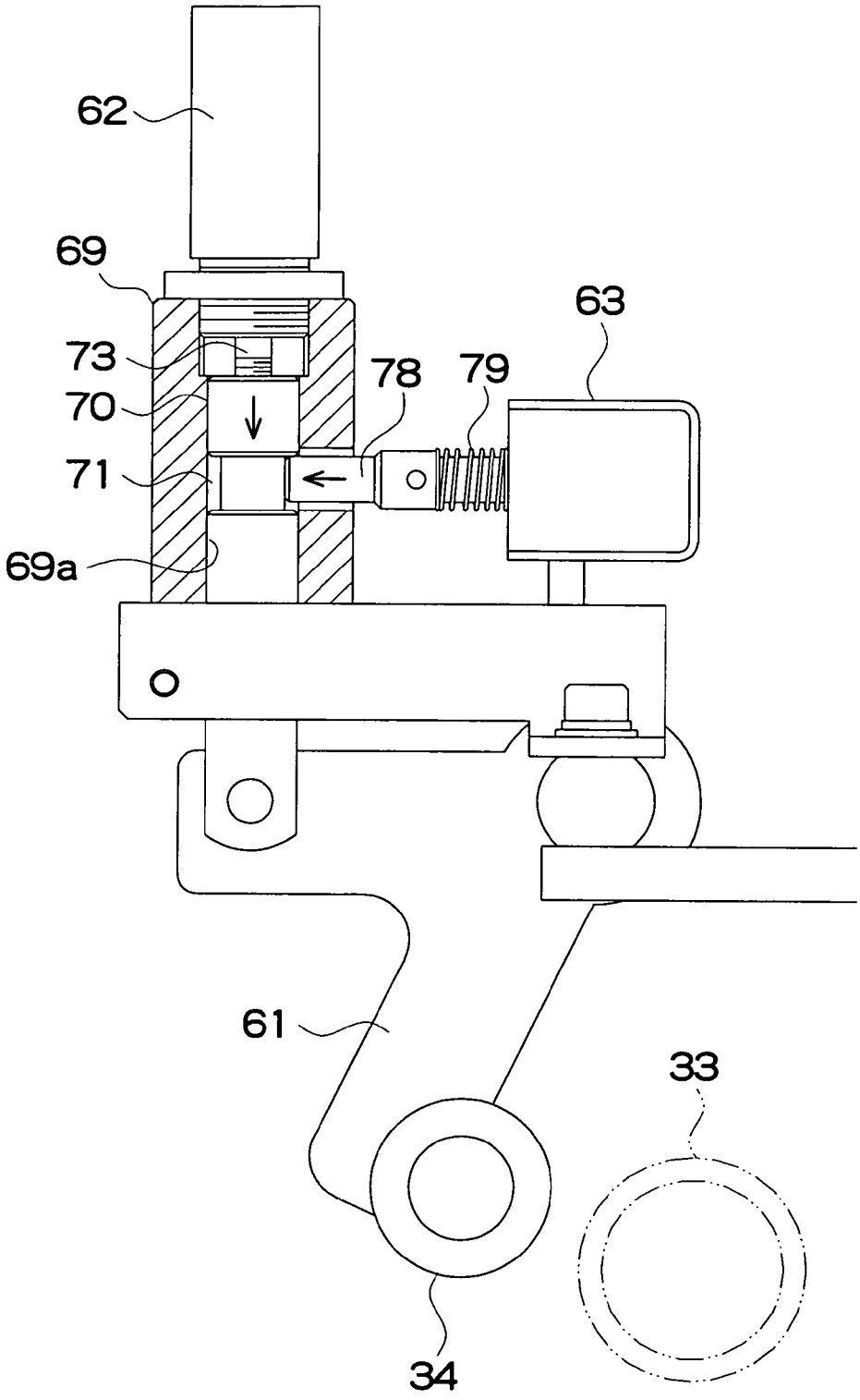
FIG. 8 is a cross-sectional view showing a canceling operation of the switching mechanism.

After the embroidery process has been finished, the air cylinder 62 separates the pressure roller 34 from the drive roller 33, then the solenoid 63 is demagnetized, and the stopper 78 locks the coupling 70 (refer to FIG. 6). In the case of halting only a part of the embroidery sewing machines 1, the switches 27 on the tension bases 22 are turned off. When the multi-head embroidery sewing machine 100 is restarted in this state, the air cylinders 62 are energized in all of the embroidery sewing machines 1. However, as shown in FIG. 8, because the solenoid 63 is demagnetized in the embroidery sewing machine 1 during halt, the stopper 78 is not unlocked from the coupling 70, thereby locking the output shaft 73 in a position slightly lower than the upper limit position. As a result, the pressure roller 34 is held in the separated position from the drive roller 33; the needle thread feeding device 31 stops; and the operation of feeding the selected needle thread ET is canceled.

According to the multi-head embroidery sewing machine 100 of the present embodiment, because the solenoid 63 drives the stopper 78, and the stopper 78 mechanically locks the output shaft 73 of the air cylinder 62, the necessity of providing each of the embroidery sewing machines 1 with an expensive switching valve is eliminated. Consequently, the air supply system can be structured so as to be simple and inexpensive, and in addition, drop-off or leakage of the air piping 64 can be reduced, thereby enabling to enhance the operational reliability of the needle thread feeding device 31. In addition, because the stopper 78 is locked to the coupling 70, and the coupling 70 is guided by the guide member 69 so as to move straight, the output shaft 73 can be protected from impact caused by the stopper 78 and from impact associated with the contact between the drive roller 33 and the pressure roller 34, and also, the durability of the air cylinder 62 can be improved.

Second Embodiment

Figure 9:
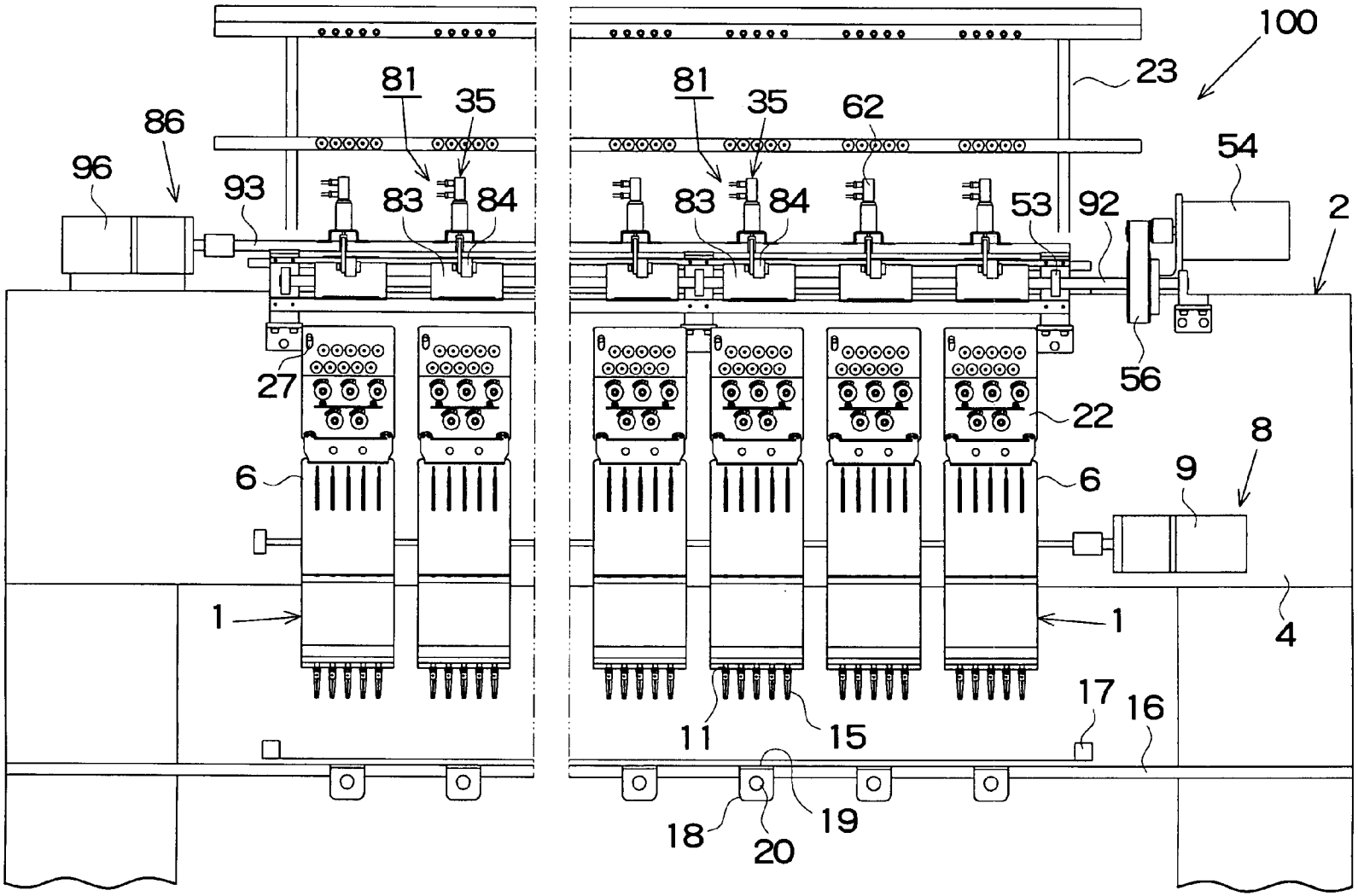
FIG. 9 is a front view of a multi-head embroidery sewing machine according to a second embodiment of the present invention.
Figure 10:
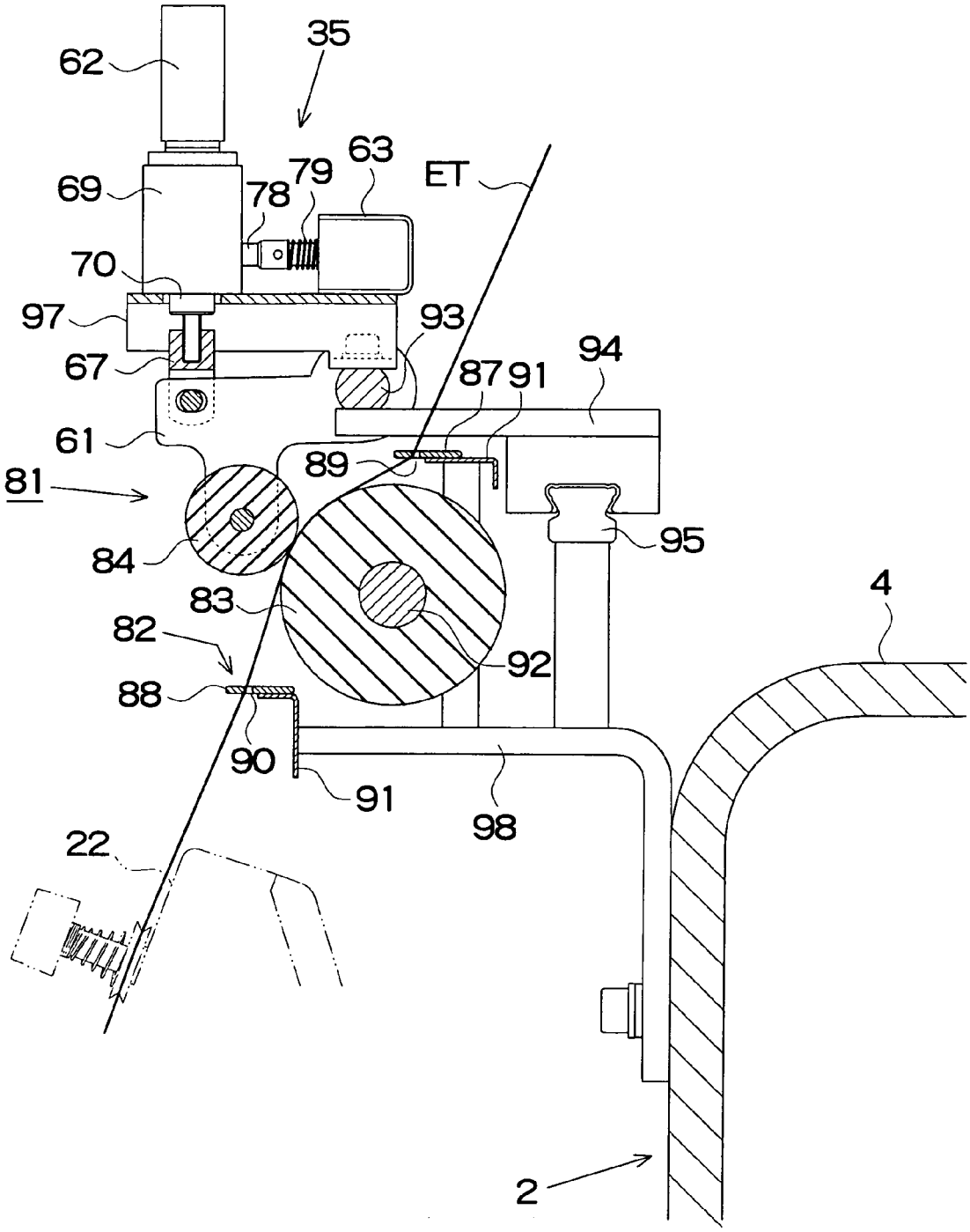
FIG. 10 is a cross-sectional view showing a needle thread feeding device for a multi-needle embroidery sewing machine.

Next, a second embodiment of the present invention will be described according to FIGS. 9 to 11. As shown in FIGS. 9 and 10, a needle thread feeding device 81 of the second embodiment is structured such that a needle thread guide mechanism 82 and a drive roller 83 are installed on the beam portion 4 of the sewing machine frame 2, a pressure roller 84 is provided in a movable manner relative to the beam portion 4, and a thread distributing mechanism 86 moves the pressure roller 84 and a switching mechanism 35 relative to the needle thread guide mechanism 82 in the axial direction of the drive roller 83. The structure different from that of the first embodiment will be described below. In the drawings, the same reference numeral as that of the first embodiment indicates a component member already described.

Figure 11A:
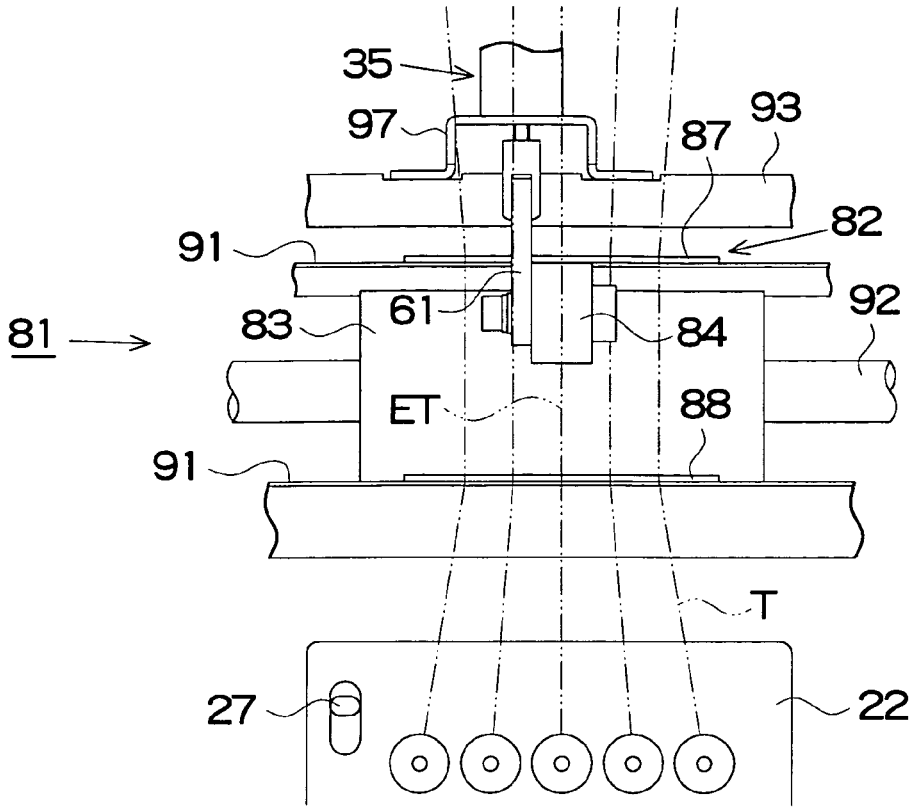
FIGS. 11A and 11B are front views showing an operation of the needle thread feeding device.
Figure 11B:
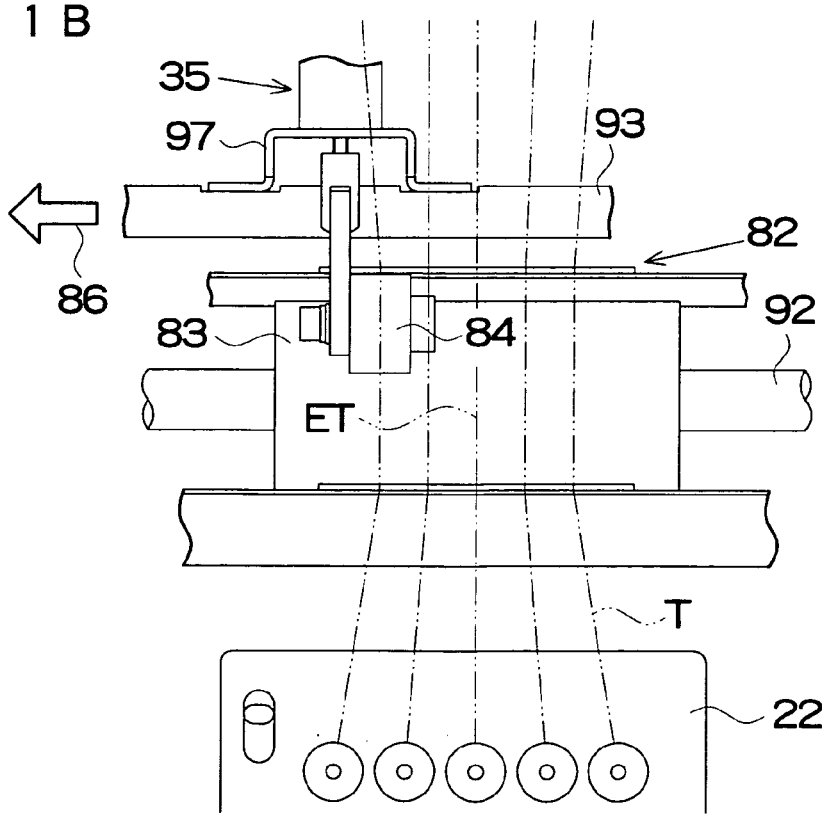

As shown in FIGS. 10 and 11, the needle thread guide mechanism 82 is provided with two thread guides 87 and 88 vertically opposing each other at a distance substantially equal to the diameter of the drive roller 83, and the thread guides 87 and 88 are provided with a plurality of threading holes 89 and 90 for arranging and guiding the needle threads T. The thread guides 87 and 88 are mounted on upper and lower plates 91, and the plates 91 are attached on the beam portion 4 through a mounting member 98. The drive roller 83 is formed into a cylindrical shape of a comparatively large diameter having a length that extends across the plurality of needle threads T, and installed in a fixed manner on a rotating shaft 92 that is long in the right-left direction, in a position corresponding to each of the multi-needle embroidery sewing machines 1. The rotating shaft 92 is installed across the beam portion 4 by the bearings 53, and driven by the motor 54 through the belt 56 (refer to FIG. 9).

The pressure roller 84 is supported by the lever 61, and the lever 61 is rotatably supported on a long-sized slide shaft 93. The slide shaft 93 is supported by a rail 95 on the mounting member 98 through a bearing plate 94, and driven by a motor 96 of the thread distributing mechanism 86 along an axis parallel to the rotating shaft 92. A movable base plate 97 is mounted on the slide shaft 93 in a position corresponding to the lever 61, and on the movable base plate 97, the switching mechanism 35 with the same structure as that of the first embodiment is installed. Moreover, the thread distributing mechanism 86 slides the switching mechanism 35 together with the pressure roller 84, and interposes the one selected needle thread ET between the drive roller 83 and the pressure roller 84.

Therefore, according to the needle thread feeding device 81 of the second embodiment, because the drive roller 83 is formed to have a length that extends across the plurality of needle threads T, the one selected needle thread ET out of the needle threads T can be held between the two rollers 83 and 84, and fed out in a stretched state, in the same manner as in the first embodiment. In addition, because the needle thread guide mechanism 82 guides the needle threads T in a fixed position on the sewing machine frame 2, the thread vibration during the color change can be prevented, and also the thread holding operation by the pressure roller 84 can be stabilized. Note that the action and effect of canceling the needle thread feeding operation in a part of the embroidery sewing machines 1 are the same as those in the case of the multi-head embroidery sewing machine 100 of the first embodiment.

Third Embodiment

Figure 12:
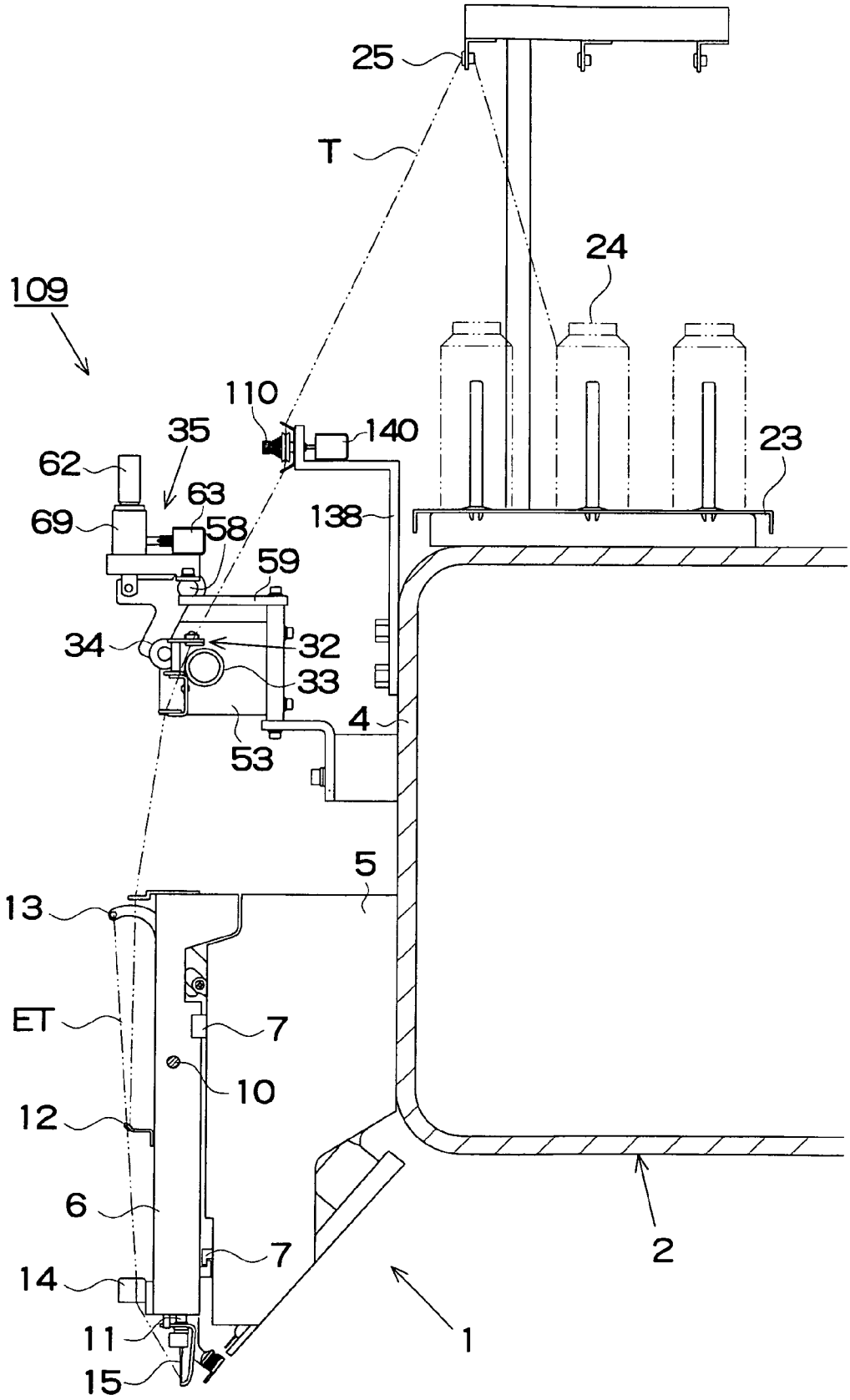
FIG. 12 is a side view showing a single unit of multi-needle embroidery sewing machine according to a third embodiment of the present invention.
Figure 13:
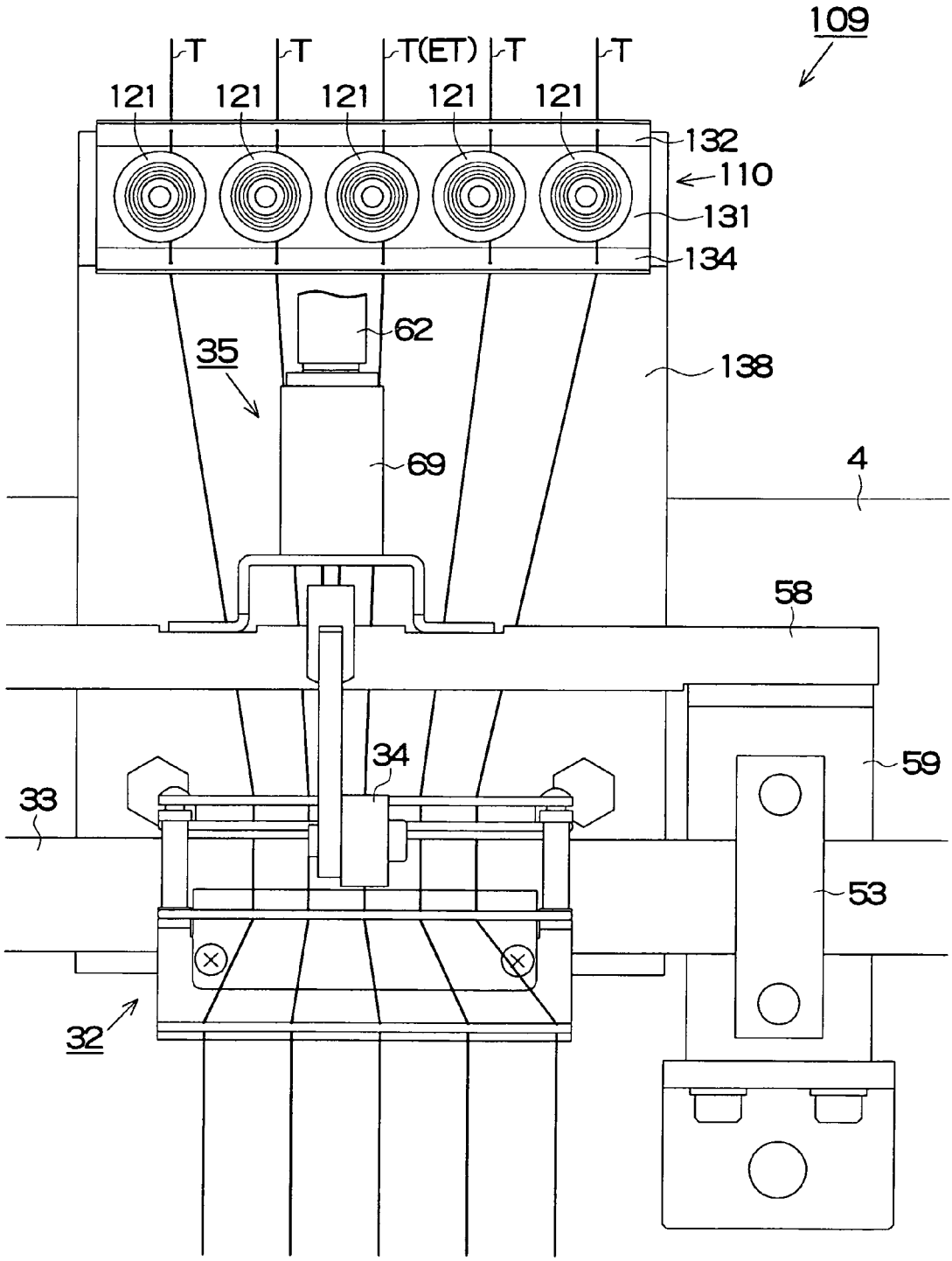
FIG. 13 is a front view showing a needle thread feeding device for the multi-needle embroidery sewing machine.

Next, a third embodiment of the present invention will be described according to FIGS. 12 to 14. The third embodiment differs from the first embodiment in that the tension base 22 is not installed, and in that, instead of the needle thread feeding device 31 of the first embodiment, another needle thread feeding device 109 that differs therefrom is installed. Description will be made below of the points in which the other needle thread feeding device 109 differs from the needle thread feeding device 31 of the first embodiment. In the drawings, the same reference numeral as that of the first embodiment indicates a component member already described.

The needle thread feeding device 109 differs from the needle thread feeding device 31 of the first embodiment in that the base 37 to be mounted on the tension base 22 is not provided, and in that a holding unit 110, an open/close mechanism 140, and a control unit (not shown) are provided. Note that, in the same manner as in the first embodiment, the switching mechanism 35 switches between the pressing state in which the pressure roller 34 presses the selected needle thread ET onto the drive roller 33 and the non-pressing state in which the pressure roller 34 does not press the selected needle thread ET.

The holding unit 110 is a member that holds the selected needle thread ET in the non-wound, stretched state and applies a tension to the selected needle thread ET during sewing. The holding unit 110 is mounted on the beam portion 4 of the sewing machine frame 2 through a mounting member 138 so as to be located on the upstream side from the drive roller 33 (the thread supply source 24 side) in the needle thread feeding direction. The holding unit 110 includes pluralities of fixed plates 111 and movable plates 121 provided for respective needle threads T, and a guide member 131.

The fixed plates 111 are provided in front of the mounting member 138 so as to be arranged side by side in the right-left direction. Each of the fixed plates 111 is a plate of a disk shape provided with a shaft hole in the central portion, and is fixed to the front end of a fixed shaft 116 that protrudes forward from the front surface of the mounting member 138, with the front end portion of the fixed shaft 116 being inserted in the shaft hole. The fixed shaft 116 is a shaft of a pipe shape, and fixed at the rear end portion thereof to a support hole 139 formed through the mounting member 138, with the rear end being inserted in the support hole 139.

The movable plates 121 are provided in front of the fixed plates 111, one for each corresponding plate. Each of the movable plates 121 is a plate of a disk shape provided with a shaft hole in the central portion, and is supported in a manner displaceable in the front-rear direction at an intermediate portion in the front-rear direction of a movable shaft 126 by inserting through the shaft hole the movable shaft 126 that protrudes forward from the front end of the fixed shaft 116. The rear portion of the movable shaft 126 is inserted in the fixed shaft 116 of a pipe shape in a manner displaceable in the front-rear direction, and a front end 127 thereof is linked to the front surface of the movable plate 121 through a spring 128.

The guide member 131 is a member of a plate shape extending in the right-left and up-down directions. The guide member 131 is located between rear surfaces of the plurality of fixed plates 111 arranged in the right-left direction and the front surface of the mounting member 138 and fixed on the front surface of the mounting member 138 by the fixed shaft 116 and the movable shaft 126 passing there through. An upper portion 132 and a lower portion 134 of the guide member 131 are bent forward, and in both of the upper portion 132 and the lower portion 134, guide holes 133 and 135 are provided to guide the needle threads T between the corresponding fixed plates 111 and the corresponding movable plates 121.

Figure 14A:
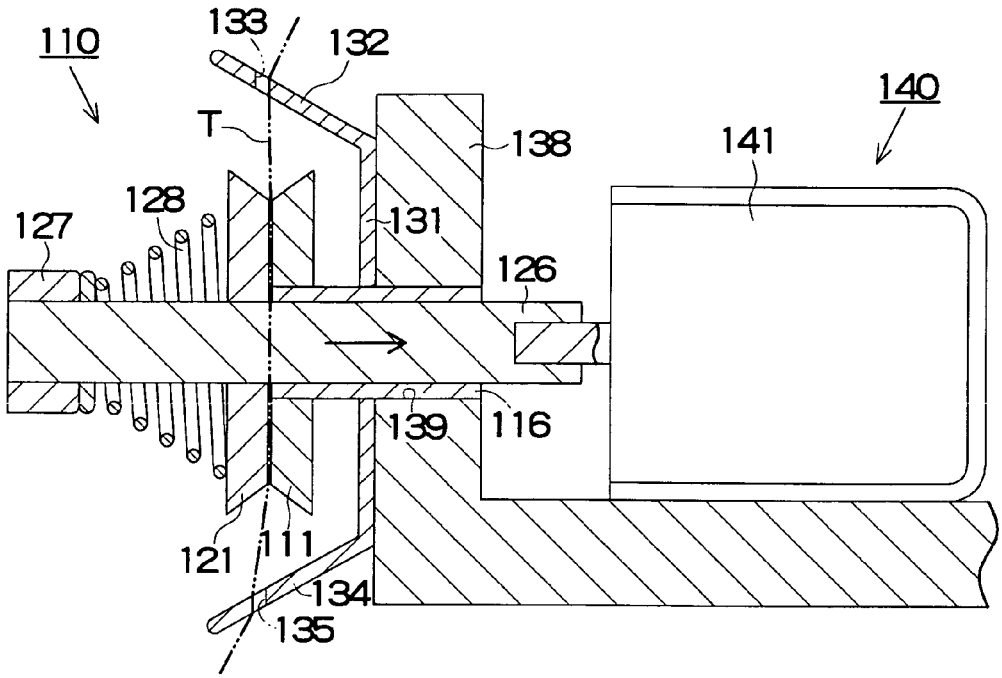
FIGS. 14A and 14B are side cross-sectional views showing a holding unit of the needle thread feeding device.
Figure 14B:
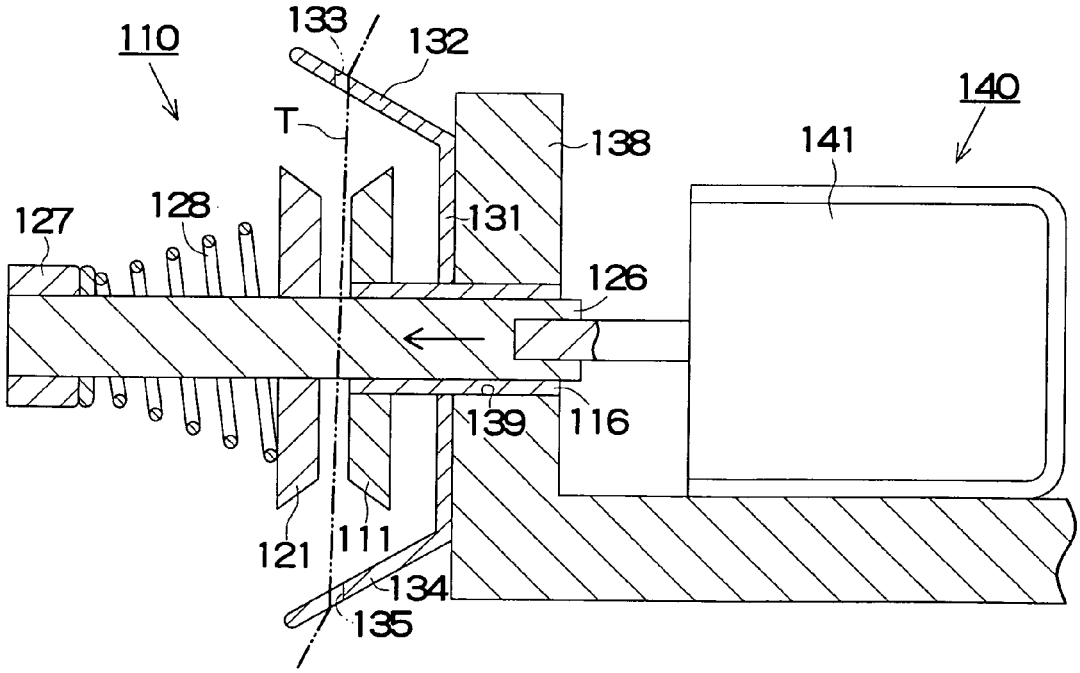

The open/close mechanism 140 is a mechanism that switches between a holding state in which the holding unit 110 holds the selected needle thread ET and a non-holding state in which the holding unit 110 does not hold the selected needle thread ET. The open/close mechanism 140 is composed of a plurality of actuators 141 respectively linked to the rear ends of the corresponding movable shafts 126. Each of the actuators 141 presses the rear surface of each movable plate 121 to the front surface of the fixed plate 111 through the spring 128 by driving the movable shaft 126 rearward, as shown in FIG. 14A, and separates the rear surface of each movable plate 121 from the front surface of the fixed plate 111 by driving the movable shaft 126 forward, as shown in FIG. 14B. Although a specific aspect of the actuator 141 is not particularly limited, a rotary solenoid, a pulse motor, and the like are conceivable.

The control unit (not shown) is an apparatus that controls the switching mechanism 35 and the open/close mechanism 140 to switch between a roller-in-use state and a holding-unit-in-use state. In the roller-in-use state, the drive roller 33 feeds out the selected needle thread ET while the holding unit 110 does not apply a tension to the selected needle thread ET. In contrast, in the holding-unit-in-use state, the holding unit 110 applies a tension to the selected needle thread ET while the drive roller 33 does not feed out the selected needle thread ET. This control unit (not shown) is incorporated in the controller (not shown) shared by all of the embroidery sewing machines 1. Based on the control by this control unit (not shown), an operation of actually performing the switching between the roller-in-use state and the holding-unit-in-use state will be shown below.

First, in a situation in which the quantity of use of the selected needle thread ET can be easily predicted (in a situation in which a prediction with a certain degree of accuracy is possible), the non-holding state described above is achieved by separating the movable plate 121 corresponding to the selected needle thread ET from the fixed plate 111 as shown in FIG. 14B while the pressing state described above is achieved by pressing the pressure roller 34 onto the drive roller 33. Thus, the switching to the roller-in-use state described above is carried out.

On the other hand, in a situation in which the quantity of use of the selected needle thread ET can not be easily predicted (in a situation in which a large error is expected to occur), the holding state described above is achieved by pressing the movable plate 121 corresponding onto the selected needle thread ET to the fixed plate 111 as shown in FIG. 14A while the non-pressing state described above is achieved by separating the pressure roller 34 from the drive roller 33. Thus, the switching to the holding-unit-in-use state described above is carried out.

Note that, in both of the roller-in-use state and the holding-unit-in-use state, every one of the movable plates 121 except the movable plate 121 corresponding to the selected needle thread ET is always pressed onto the fixed plate 111, as shown in FIG. 14A. Therefore, all of the needle threads T except the selected needle thread ET are always held respectively by the corresponding movable plates 121 and the corresponding fixed plates 111.

According to the needle thread feeding device 109 of the third embodiment, in the situation in which the quantity of use of the selected needle thread ET can be easily predicted, the roller-in-use state is employed, whereas in the situation in which the quantity of use of the selected needle thread ET can not be easily predicted, the holding-unit-in-use state is employed, as described above. Thus, both of the situations can be appropriately dealt with.

The present invention is not limited to the embodiments described above, and can be put into practice by making appropriate changes as described below within the scope of the invention.

(1) In the multi-needle embroidery sewing machine not equipped with the tension base 22, the base 37 of the needle thread guide mechanism 32 is mounted on the sewing machine head 6.
(2) In the needle thread guide mechanism 32 shown in FIG. 4, the third thread guide 48 is omitted.
(3) In the switching mechanism 35 shown in FIGS. 6 and 10, the stopper 78 is driven by an electric motor.
(4) In the needle thread feeding device 81 shown in FIG. 10, the scraper 50 shown in FIG. 4 is added on the front surface side of the drive roller 83.

Reference Signs List

1 Multi-needle embroidery sewing machine
2 Sewing machine frame
6 Sewing machine head
8 Color change mechanism
15 needle
31 Needle thread feeding device (First embodiment)
32 Needle thread guide mechanism
33 Drive roller
34 Pressure roller
35 Switching mechanism
36 Thread distributing mechanism
41 First thread guide
42 Flexible member
46 Second thread guide
50 Scraper
62 Air cylinder
63 Solenoid
69 Guide member
70 Coupling
71 Locking groove
73 Output shaft
78 Stopper
81 Needle thread feeding device (Second embodiment)
82 Needle thread guide mechanism
83 Drive roller
84 Pressure roller
86 Thread distributing mechanism
87 Thread guide
88 Thread guide
100 Multi-head embroidery sewing machine
109 Needle thread feeding device (Third embodiment)
110 Holding unit
140 Open/close mechanism Citation List Patent Literature 1: JP-A-59-59961

The invention claimed is:

1. A needle thread feeding device for a multi-needle embroidery sewing machine that moves a sewing machine head to selectively locate one of a plurality of needles in a sewing position, and feeds out, out of a plurality of needle threads, a selected needle thread passing through the one of the needles in the sewing position from a needle thread supply source to the one of the needles, the needle thread feeding device comprising:

a drive roller having a length that extends across the plurality of needle threads;

a needle thread guide mechanism that arranges the needle threads side by side in an axial direction of the drive roller and guides the needle threads;

a pressure roller that presses the selected needle thread onto the drive roller; and a thread distributing mechanism that moves one of the needle thread guide mechanism and the pressure roller relative to the other of the needle thread guide mechanism and the pressure roller in the axial direction of the drive roller in synchronization with a movement of the sewing machine head, wherein the thread distributing mechanism interposes the selected needle thread between the drive roller and the pressure roller.

2. The needle thread feeding device for a multi-needle embroidery sewing machine according to claim 1, wherein the drive roller and the pressure roller are installed on a sewing machine frame, the needle thread guide mechanism is provided so as to be movable as a unit with the sewing machine head, and the thread distributing mechanism moves the needle thread guide mechanism relative to the pressure roller in the axial direction of the drive roller.

3. The needle thread feeding device for a multi-needle embroidery sewing machine according to claim 1, wherein the drive roller and the needle thread guide mechanism are installed on the sewing machine frame, the pressure roller is provided so as to be movable relative to the sewing machine frame, and the thread distributing mechanism moves the pressure roller relative to the needle thread guide mechanism in the axial direction of the drive roller.

4. The needle thread feeding device for a multi-needle embroidery sewing machine according to claim 1, wherein the needle thread guide mechanism includes a flexible member that applies a tension to the needle threads on an upstream side from the drive roller in a needle thread feeding direction.

5. The needle thread feeding device for a multi-needle embroidery sewing machine according to claim 1, wherein the needle thread guide mechanism includes a scraper that scrapes the selected needle thread off a surface of the drive roller.

6. The needle thread feeding device for a multi-needle embroidery sewing machine according to claim 1, wherein the needle thread guide mechanism includes a pair of thread guides that oppose each other at a distance substantially equal to a diameter of the drive roller.

7. The needle thread feeding device for a multi-needle embroidery sewing machine according to claim 6, wherein each of the thread guides is provided with a threading hole that guides the needle threads while spacing apart the needle threads from the drive roller.

8. The needle thread feeding device for a multi-needle embroidery sewing machine according to claim 1, further comprising:

a switching mechanism that switches between a pressing state in which the pressure roller presses the selected needle thread onto the drive roller and a non-pressing state in which the pressure roller does not press the selected needle thread;

a holding unit that applies a tension to the selected needle thread by holding the selected needle thread on at least one of an upstream side and a downstream side from the drive roller in a needle thread feeding direction;

an open/close mechanism that switches between a holding state in which the holding unit holds the selected needle thread and a non-holding state in which the holding unit does not hold the selected needle thread; and a control unit that controls the switching mechanism and the open/close mechanism to switch between a roller-in-use state in which the pressure roller is made to be in the pressing state while the holding unit is made to be in the non-holding state, and a holding-unit-in-use state in which the pressure roller is made to be in the non-pressing state while the holding unit is made to be in the holding state.

9. The needle thread feeding device for a multi-needle embroidery sewing machine according to claim 1, further comprising:

a folded portion and a scraper disposed on opposing sides of the drive roller to scrape the selected needle thread off a surface of the drive roller.

10. The needle thread feeding device for a multi-needle embroidery sewing machine according to claim 1, further comprising:

a scraper to scrape the selected needle thread off a surface of the drive roller.

11. The needle thread feeding device for a multi-needle embroidery sewing machine according to claim 1, wherein the needle thread guide mechanism comprises a pair of thread guides located at opposing sides of the drive roller.

12. The needle thread feeding device for a multi-needle embroidery sewing machine according to claim 1, further comprising:

a switching mechanism that switches between a pressing state in which the pressure roller presses the selected needle thread onto the drive roller and a non-pressing state in which the pressure roller does not press the selected needle thread.

13. The needle thread feeding device for a multi-needle embroidery sewing machine according to claim 1, further comprising:

a holding unit that applies a tension to the selected needle thread by holding the selected needle thread on at least one of an upstream side and a downstream side from the drive roller in a needle thread feeding direction.

14. The needle thread feeding device for a multi-needle embroidery sewing machine according to claim 13, further comprising:

an open/close mechanism that switches between a holding state in which the holding unit holds the selected needle thread and a non-holding state in which the holding unit disengages with the selected needle thread.

15. The needle thread feeding device for a multi-needle embroidery sewing machine according to claim 1, wherein the pressure roller is disengaged with needle threads of the plurality of needle threads other than the selected needle thread.

16. A needle thread feeding device, comprising:

a drive roller;

a needle thread guide mechanism that arranges the needle threads side by side in an axial direction of the drive roller and guides the needle threads;

a pressure roller that presses a selected needle thread, out of a plurality of needle threads that pass across the driver roller, onto the drive roller; and a thread distributing mechanism that relatively moves the needle thread guide mechanism and the pressure roller in the axial direction of the drive roller in synchronization with a movement of a sewing machine head, wherein the thread distributing mechanism interposes a selected needle thread of the needle threads between the drive roller and the pressure roller.

17. The needle thread feeding device of claim 16, wherein the needle thread feeding device moves the sewing machine head to selectively locate one of a plurality of needles in a sewing position, and feeds out, out of a plurality of needle threads, the selected needle thread passing through the one of the needles from a needle thread supply source to the one of the needles.

18. The needle thread feeding device of claim 16, wherein the needle thread guide mechanism comprises a scraper that scrapes the selected needle thread off a surface of the drive roller.

19. The needle thread feeding device of claim 16, wherein the needle thread guide mechanism comprises a pair of thread guides that oppose each other at a distance substantially equal to a diameter of the drive roller.

20. The needle thread feeding device of claim 16, wherein the pressure roller is disengaged with needle threads of the plurality of needle threads other than the selected needle thread.

* * * * *